US007308797B2

(12) United States Patent
Li et al.

(10) Patent No.: US 7,308,797 B2
(45) Date of Patent: Dec. 18, 2007

(54) CRYOGENIC REFRIGERATOR

(75) Inventors: Rui Li, Saitama (JP); Tomohiro Koyama, Tokyo (JP); Toshikazu Suzuki, Ibaraki (JP); Takayuki Tomaru, Gumma (JP); Takakazu Shintomi, Ibaraki (JP); Tomiyoshi Haruyama, Ibaraki (JP)

(73) Assignees: Sumitomo Heavy Industries, Ltd., Tokyo (JP); High Energy Accelerator Research Organization, Ibaraki (JP)

( * ) Notice: Subject to any disclaimer, the term of this patent is extended or adjusted under 35 U.S.C. 154(b) by 295 days.

(21) Appl. No.: 10/864,396

(22) Filed: Jun. 10, 2004

(65) Prior Publication Data

US 2005/0028534 A1 Feb. 10, 2005

(30) Foreign Application Priority Data

Jun. 11, 2003 (JP) ..... 2003-165908

(51) Int. Cl.
*F25B 9/00* (2006.01)
*F25B 23/00* (2006.01)

(52) U.S. Cl. ..... 62/6; 62/467

(58) Field of Classification Search ..... 62/6, 62/60, 520, 467
See application file for complete search history.

(56) References Cited

U.S. PATENT DOCUMENTS 5,647,218 A * 7/1997 Kuriyama et al. ..... 62/6
5,647,219 A * 7/1997 Rattray et al. ..... 62/6
6,629,418 B1 * 10/2003 Gao et al. ..... 62/6
6,694,730 B2 * 2/2004 O'Baid et al. ..... 60/520

FOREIGN PATENT DOCUMENTS

| | | |
|---|---|---|
| JP | 56-66657 A | 6/1981 |
| JP | 06-034213 | 2/1994 |
| JP | 06-159835 | 6/1994 |
| JP | 2002-106993 A | 4/2002 |
| JP | 2003-148826 | 5/2003 |

* cited by examiner

*Primary Examiner*—Mohammad M. Ali
(74) *Attorney, Agent, or Firm*—Rader, Fishman & Grauer PLLC

(57) ABSTRACT

A cryogenic refrigerator includes a first refrigerant tube and a second refrigerant tube each comprising two tubes that are arranged on a cooling stage substantially parallel to each other and communicate with each other through a gas passage formed in the cooling stage. Phase differences are provided to oscillating gas pressures in the first and second refrigerant tubes, to cancel vibration of the cooling stage. Thus, the cryogenic refrigerator can be provided which can effectively reduce the vibration of the cooling stage caused by the oscillating gas pressure and can reduce the size thereof.

8 Claims, 13 Drawing Sheets

(A)

(B)

CRYOGENIC REFRIGERATOR

BACKGROUND OF THE INVENTION

1. Field of the Invention

The present invention relates to a cryogenic refrigerator including a refrigerant tube comprising two tubes that are arranged on a cooling stage substantially parallel to each other and are in communication with each other through a gas passage formed in the cooling stage. More particularly, the present invention relates to a cryogenic refrigerator suitable for a regenerative type cryogenic refrigerator such as a GM (Gifford-McMahon) type and a pulse tube type, which can effectively reduce vibration of a cooling stage due to oscillating gas pressure and can reduce the size of the cryogenic refrigerator.

2. Description of the Related Art

As a small-sized cryogenic refrigerator applied to a medical MRI diagnostic machine, a cryopump, and the like, a GM cryogenic refrigerator shown in FIG. 1 and a pulse tube cryogenic refrigerator shown in FIG. 2 have been conventionally known widely (see Japanese Patent Laid-Open Publication No. 2002-106993 (Patent Document 1), for example).

The GM cryogenic refrigerator 100 shown in FIG. 1 includes a refrigerant tube 110 comprising a regenerator 106 and a cylinder 108 that are arranged on a cooling stage 102 substantially parallel to each other and are in communication with each other through a gas passage 104. The cylinder 108 accommodates a displacer 112 therein, which is driven by a motor 114 to reciprocate in the cylinder 108. This GM cryogenic refrigerator 100 supplies high-pressure gas to the refrigerant tube 110 and collects low-pressure gas from the refrigerant tube 110, by means of a compressor 116 and the displacer 112, thereby generating cold in the cooling stage 102.

On the other hand, the pulse tube refrigerator 120 shown in FIG. 2 includes a refrigerant tube 130 comprising a regenerator 126 and a pulse tube 128 that are arranged on a cooling stage 122 substantially parallel to each other and are in communication with each other through a gas passage 124. This pulse tube cryogenic refrigerator 120 supplies high-pressure gas to the refrigerant tube 130 and collects low-pressure gas from the refrigerant tube 130 by a compressor 132, thereby generating cold in the cooling stage 122.

However, the GM cryogenic refrigerator 100 and the pulse tube cryogenic refrigerator 120 that are conventionally known has a problem that pressure oscillation of the gas in the refrigerant tube 110, 130 causes elastic extension and contraction of the refrigerant tube 110, 130, which causes the cooling stage 102, 122 to vibrate. In addition, according to the pulse tube cryogenic refrigerator 120, vibration can be reduced as a whole because it includes no portion mechanically driven, such as the displacer 112 in the GM cryogenic refrigerator 100. However, the pulse tube cryogenic refrigerator 120 is not much different from the GM cryogenic refrigerator 100 in terms of the aforementioned vibration of the cooling stage caused by elastic extension and contraction of the refrigerant tube.

As a solution of the above problem, Publication of Japanese Patent No. 2995144 (Patent Document 2) has proposed a refrigerator including two displacers that are driven in phase or in reversed phase so as to reduce vibration.

This conventionally known refrigerator has a certain effect on reduction of vibration by inertial force because vibration reduction is achieved by forming the cylinder, a connecting member of a cooling portion, and a supporting member to have polygonal shapes so as to increase the mechanical strength. However, there is a limit to reduction of vibration caused by elastic extension and contraction of the refrigerant tube in this refrigerator.

SUMMARY OF THE INVENTION

The present invention was made in order to solve the above problems. It is an object of the present invention to provide a cryogenic refrigerator that can effectively reduce vibration of a cooling stage caused by oscillating gas pressure and can reduce its size.

According to the present invention, in a cryogenic refrigerator having a refrigerant tube comprising two tubes that are arranged on a cooling stage substantially parallel to each other and are in communication with each other through a gas passage formed in the cooling stage, a plurality of such refrigerant tubes are provided, and oscillating gas pressures in those refrigerant tubes have phase differences, thereby canceling the vibration of the cooling stage. Thus, the aforementioned problems can be solved.

The tubes of the plurality of respective refrigerant tubes may be arranged at substantially constant intervals along a circumferential direction of the cooling stage in such a manner that the two tubes of each refrigerant tube are located at the farthest positions from each other.

Alternatively, the tubes of the plurality of respective refrigerant tubes may be arranged at substantially constant intervals along the circumferential direction of the cooling stage in such a manner that the two tubes of each refrigerant tube are located at the closest positions to each other.

In a case where N refrigerant tubes are provided and N is an integer larger than one, the phase difference may be set to 360/N degrees.

The two tubes may comprise a regenerator and a pulse tube or may comprise a regenerator and a cylinder accommodating a displacer therein.

Moreover, according to the present invention, in a cryogenic refrigerator having refrigerant tubes each comprising a single cylinder arranged on a cooling stage, N refrigerant tubes are arranged along a circumferential direction of the cooling stage at substantially constant intervals, where N is an integer larger than one, and oscillating gas pressures in the N refrigerant tubes have phase differences of 360/N degrees, thereby solving the aforementioned problems.

According to the cryogenic refrigerator, vibration of the cooling stage caused by the oscillating gas pressure can be effectively reduced and the size reduction can be achieved.

The above and other novel features and advantages of the present invention are described in or will become apparent from the following detailed description of preferred embodiments.

BRIEF DESCRIPTION OF THE DRAWINGS

The preferred embodiments will be described with reference to the drawings, wherein like elements have been denoted throughout the figures with like reference numerals, and wherein.

DETAILED DESCRIPTION OF THE PREFERRED EMBODIMENTS

Preferred embodiments of the present invention will be described in detail, with reference to the accompanying drawings.

Figure 1:
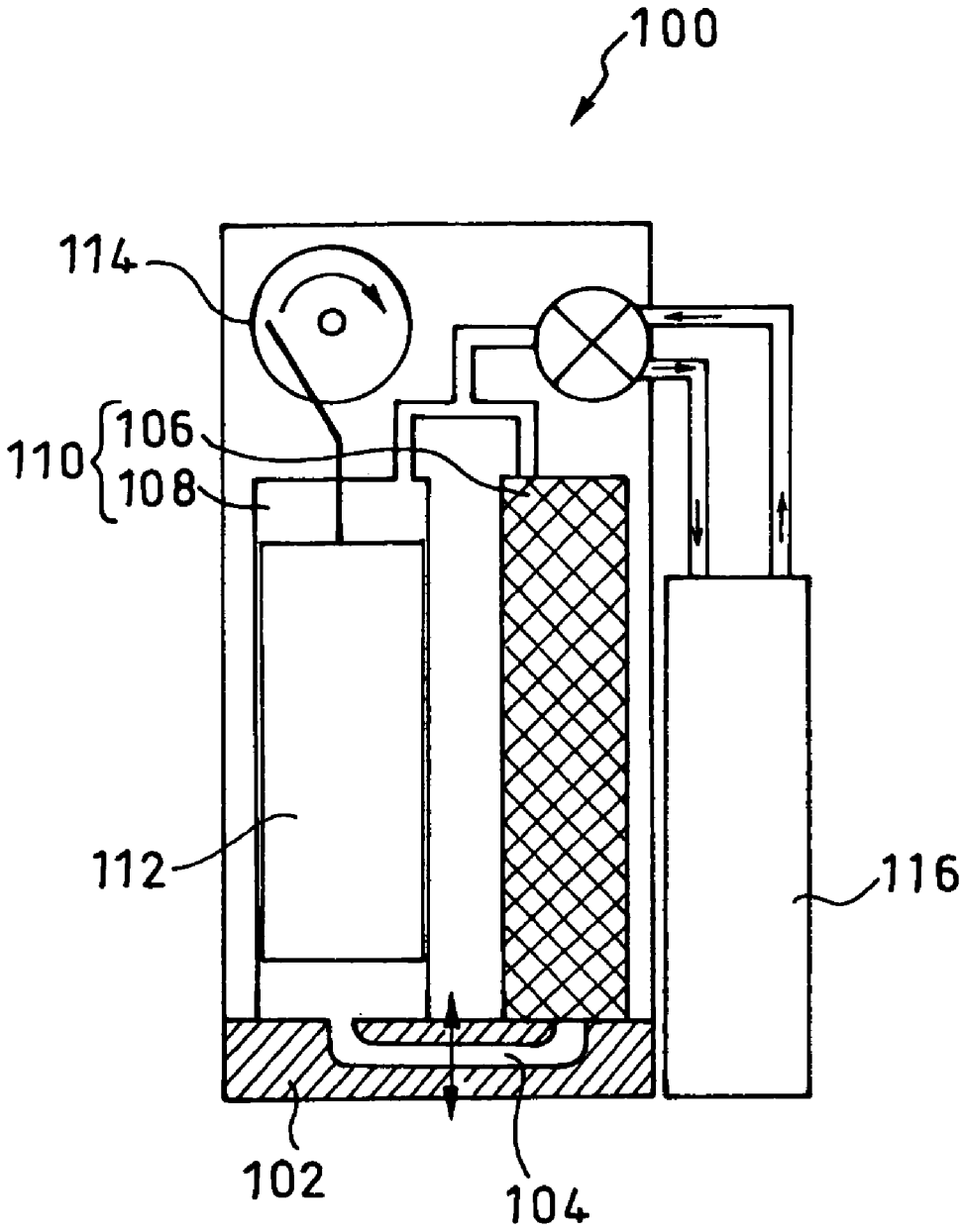
Fig. 1 PRIOR ART
FIG. 1 is a schematic view showing a conventional GM cryogenic refrigerator.
Figure 2:
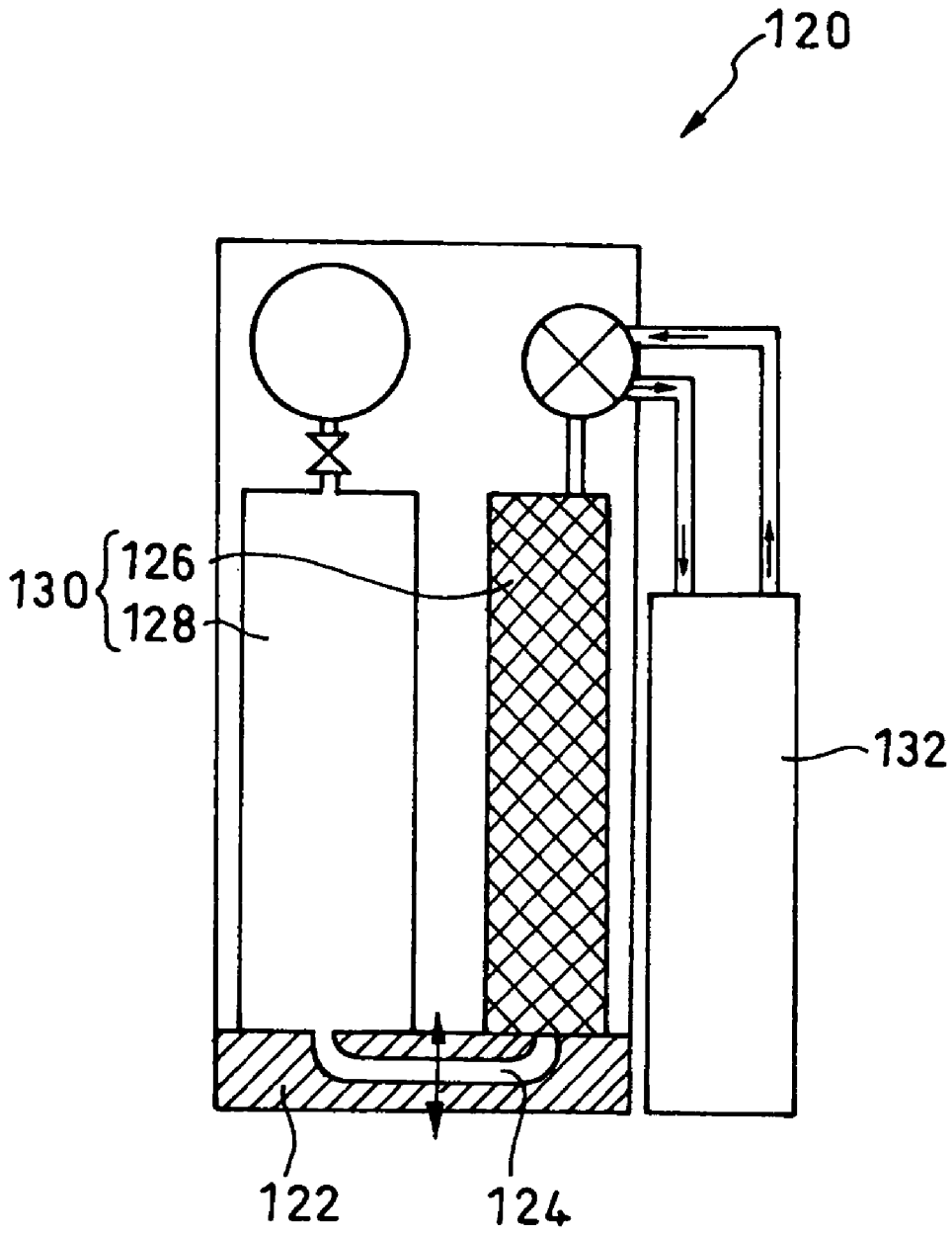
Fig. 2 PRIOR ART
FIG. 2 is a schematic view showing a conventional pulse tube cryogenic refrigerator.
Figure 3:
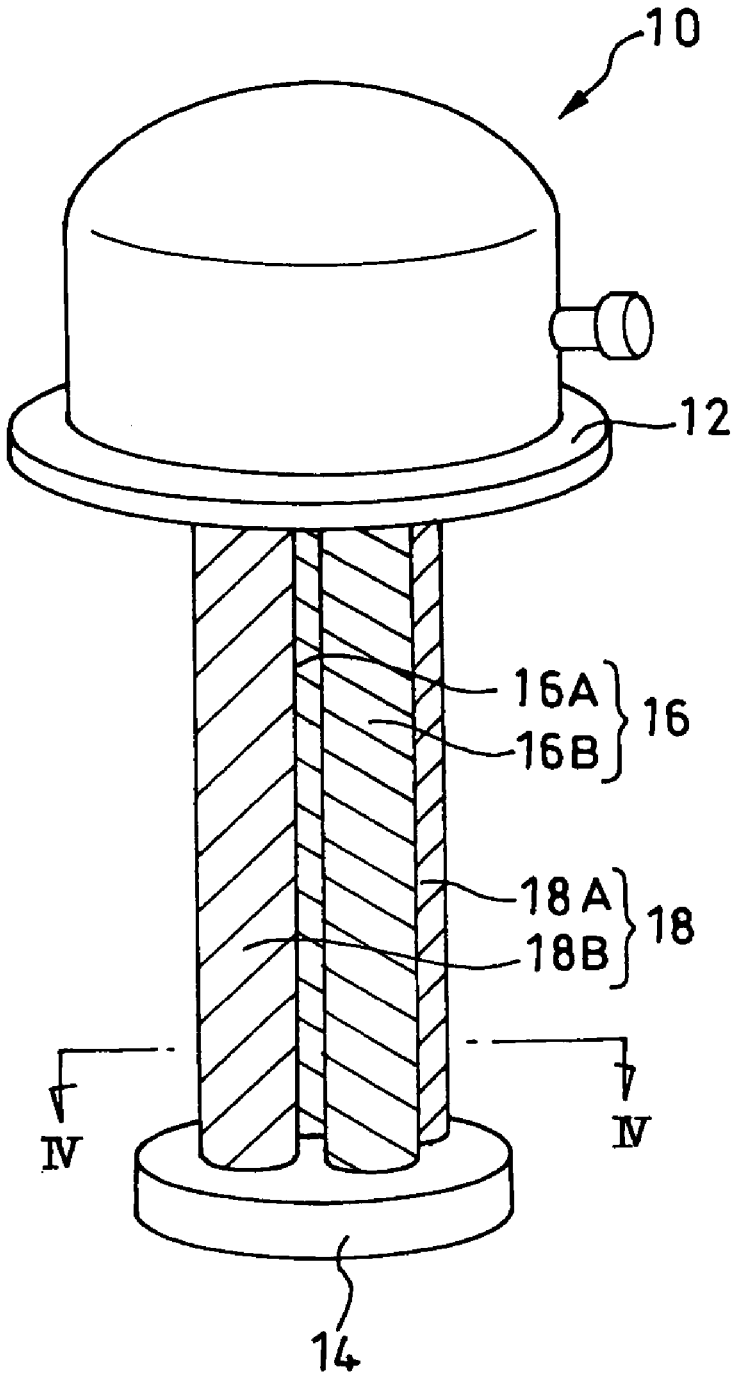
FIG. 3 is a perspective view schematically showing a cryogenic refrigerator according to an embodiment of the present invention.

As shown in the perspective view of FIG. 3, a cryogenic refrigerator 10 according to an embodiment of the present invention, includes: a high-temperature end block 12 and a cooling stage (low-temperature end block) 14 that are substantially circular plates and are arranged in upper and lower parts, respectively, in FIG. 3; and a first refrigerant tube 16 and a second refrigerant tube 18 that are arranged between the high-temperature end block 12 and the cooling stage 14.

Figure 4:
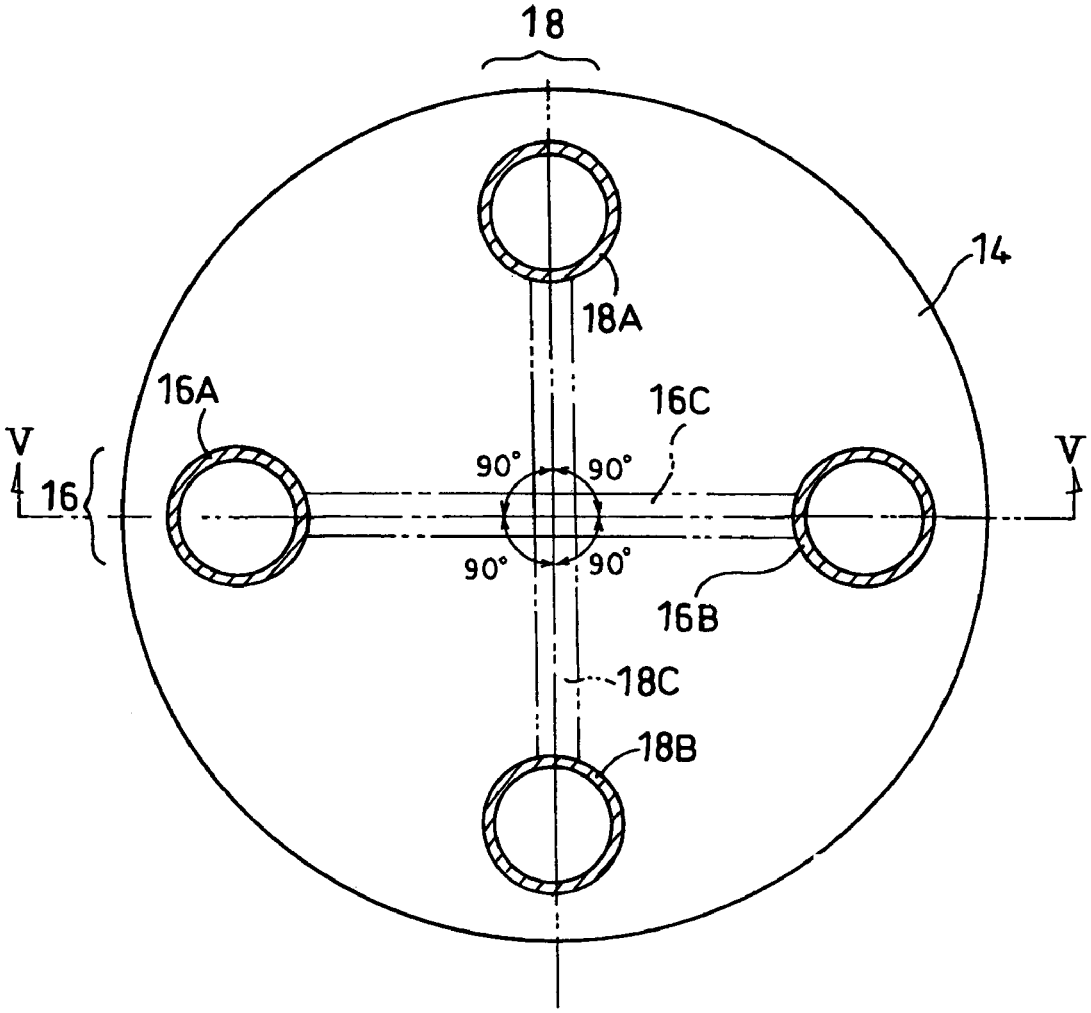
FIG. 4 is a cross sectional view of the cryogenic refrigerator taken along the line IV-IV in FIG. 3.
Figure 5:
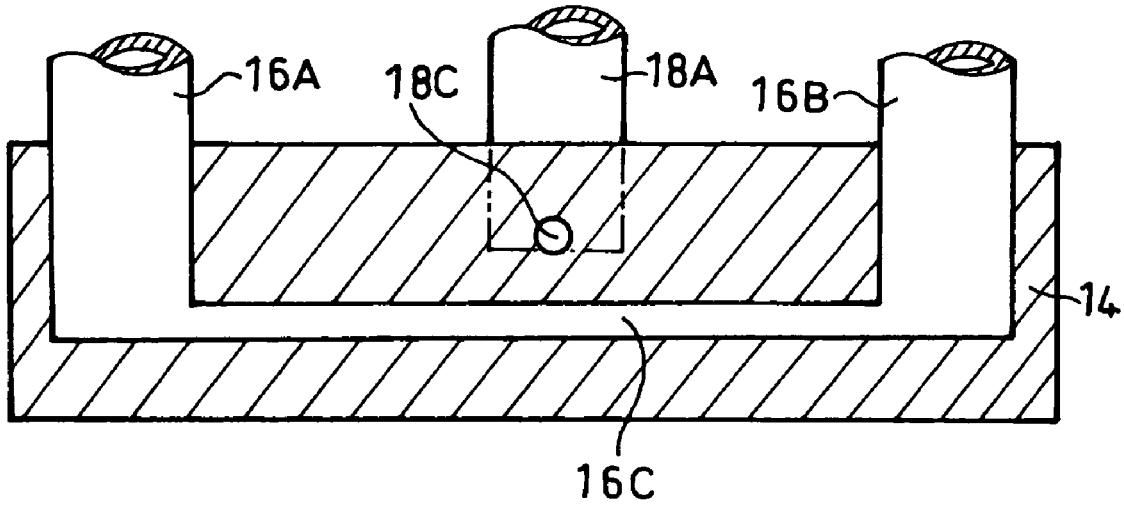
FIG. 5 is a cross sectional view of the cryogenic refrigerator taken along the line V-V in FIG. 4.
Figure 6:
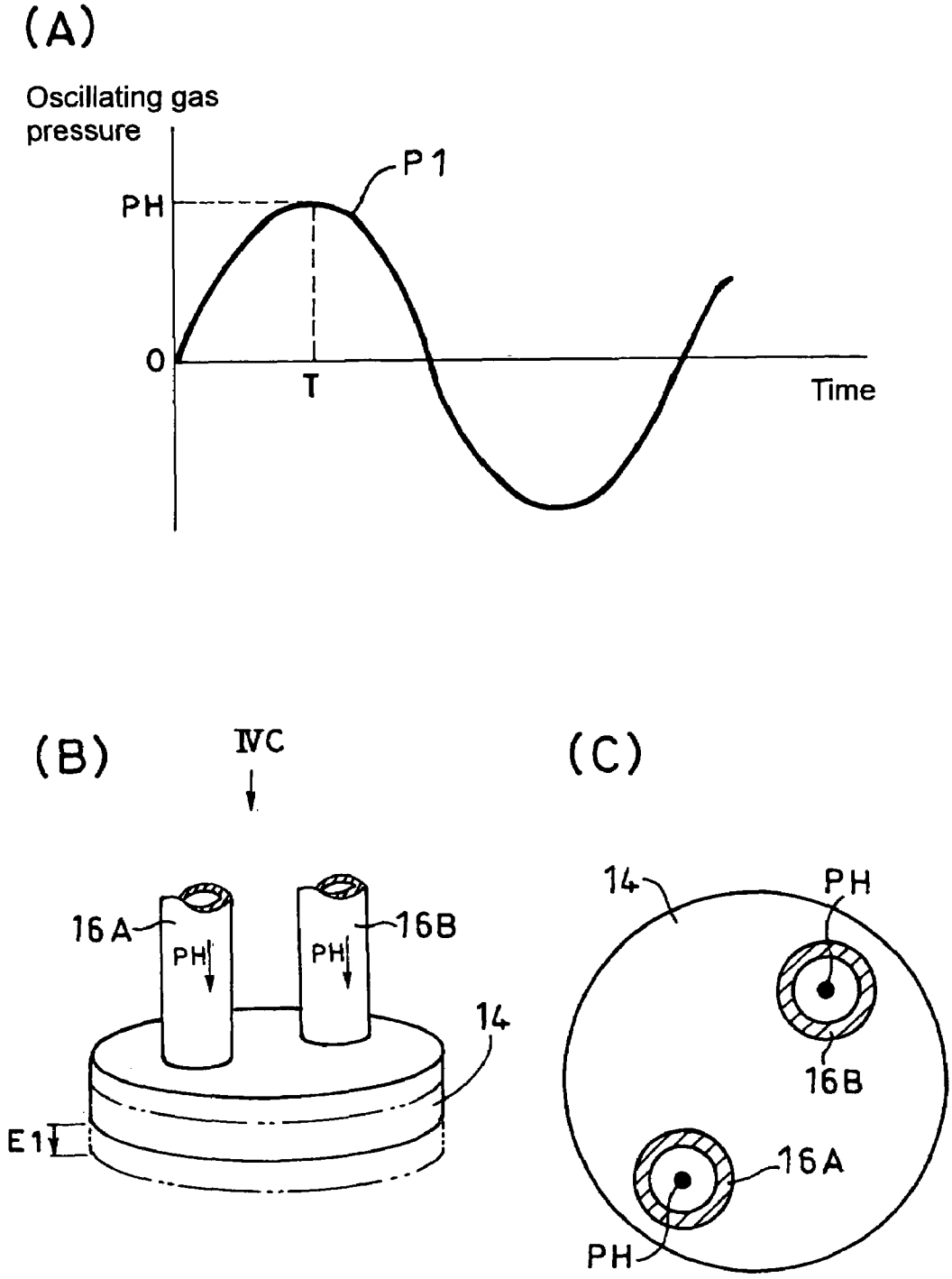
FIG. 6(A) is a graph showing a relationship between an oscillating gas pressure in the first refrigerant tube and time in FIG. 3.
FIG. 6(B) is a schematic view showing a region around a cooling stage.
FIG. 6(C) is a plan view of the region around the cooling stage.
Figure 7:
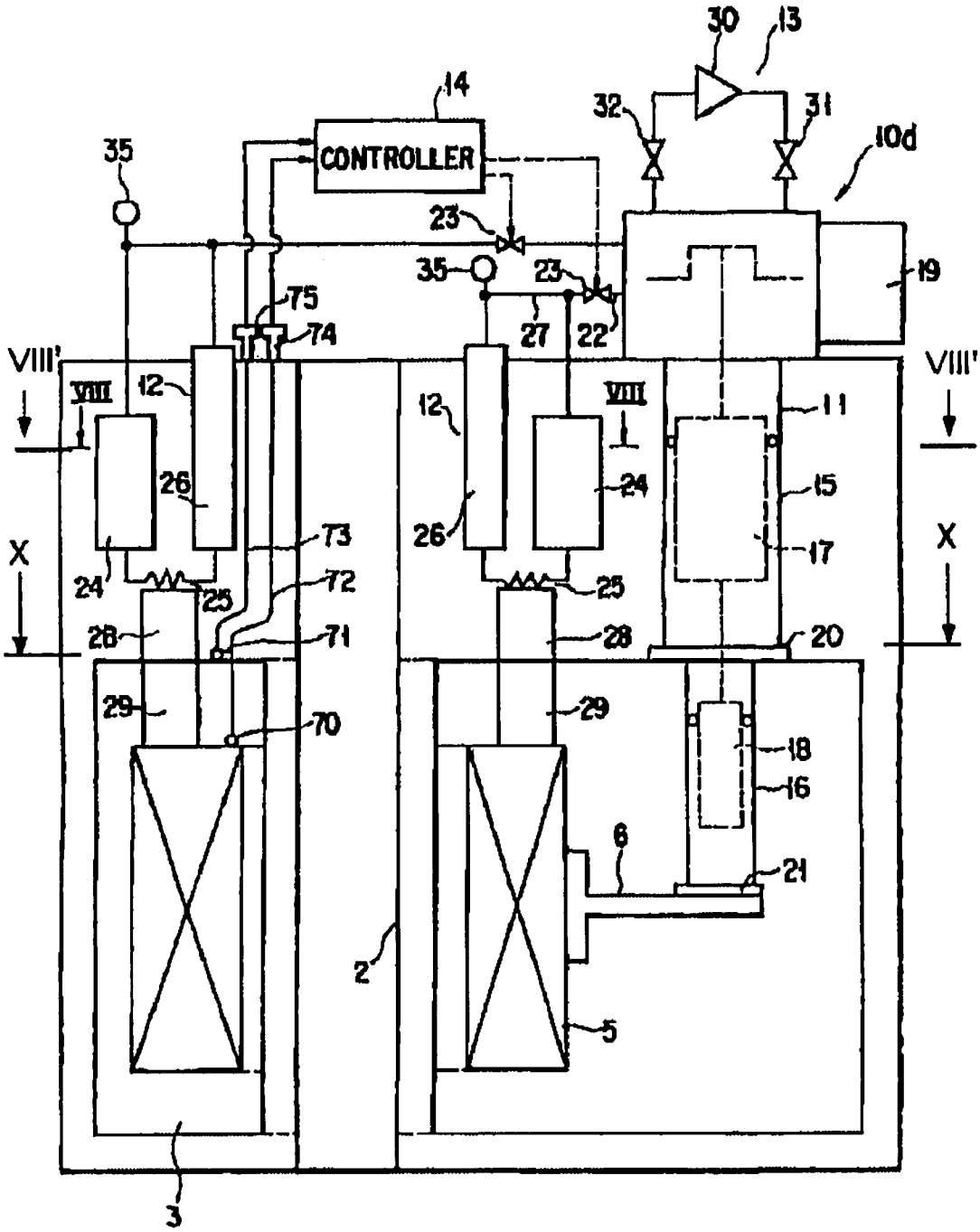
FIG. 7(A) is a graph showing a relationship between an oscillating gas pressure in the second refrigerant tube and time in FIG. 3.
FIG. 7(B) is a schematic view showing the region around the cooling stage.
FIG. 7(C) is a plan view of the region around the cooling stage.
Figure 8:
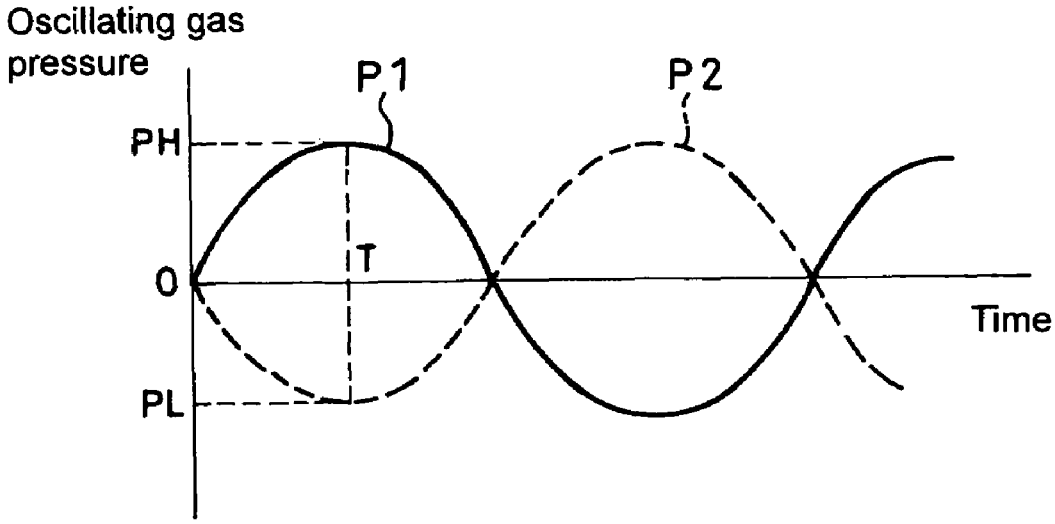
FIG. 8(A) is a graph showing a relationship between the oscillating gas pressure in the first and second refrigerant tubes and time in FIG. 3.
FIG. 8(B) is a plan view showing the region around the cooling stage.
Figure 8:
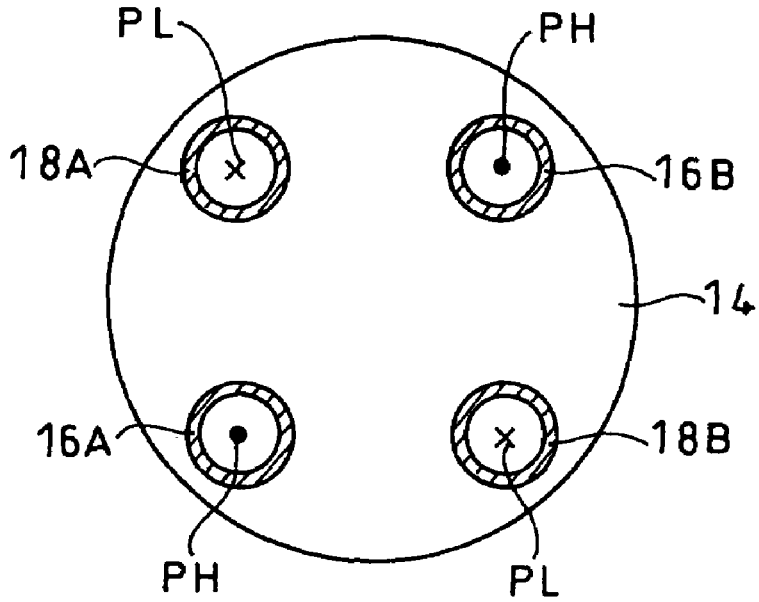

As shown in cross sectional views of FIGS. 4 and 5, the first refrigerant tube 16 includes a first pulse tube 16A and a first regenerator 16B that are substantially cylindrical and are arranged on the cooling stage 14 to be in substantially parallel to each other. High-temperature ends of the first pulse tube 16A and the first regenerator 16B are secured to the high-temperature end block 12, while low-temperature ends thereof are secured to the cooling stage 14. Moreover, the low-temperature ends of the first pulse tube 16A and the first regenerator 16B are in communication with each other through a gas passage 16C formed in the cooling stage 14.

The second refrigerant tube 18 has the same structure as the first refrigerant tube 16. The second refrigerant tube 18 includes a second pulse tube 18A and a second regenerator 18B that are substantially cylindrical and are arranged on the cooling stage 14 to be in substantially parallel to each other. High-temperature ends of the second pulse tube 18A and the second regenerator 18B are secured to the high-temperature end block 12, while low-temperature ends thereof are secured to the cooling stage 14. In addition, the low-temperature ends of the second pulse tube 18A and the second regenerator 18B are in communication with each other through a gas passage 18C formed in the cooling stage 14.

The above four tubes, i.e., the first pulse tube 16A and the first regenerator 16B of the first refrigerant tube 16 and the second pulse tube 18A and the second regenerator 18B of the second refrigerant tube 18 are arranged along the circumferential direction of the cooling stage 14 at substantially constant intervals in such a manner that the first pulse tube 16A and the first regenerator 16B are located at the farthest positions from each other (the same is true for the second pulse tube 18A and the second regenerator 18B). The gas passage 16C of the first refrigerant tube 16 crosses with the gas passage 18C of the second refrigerant tube 18 at two-level crossing around the center of the cooling stage 14.

Next, effects of the cryogenic refrigerator 10 will be described with reference to FIGS. 6(A) through 8(B).

As shown in FIG. 6(A), oscillating gas pressure P1 in the first refrigerant tube 16 is controlled to be changed periodically due to supply of high-pressure gas to the first refrigerant tube 16 and recovery of the low-pressure gas from the first refrigerant tube 16. As a result, this changes of the oscillating gas pressure P1 causes extension and contraction of the first pulse tube 16A and the first regenerator 16B of the first refrigerant tube 16 in the axial direction, thus causing the axial displacement of the cooling stage 14. For example, at time T in FIG. 6(A), the oscillating gas pressure PH causes the first pulse tube 16A and the first regenerator 16B to extend in the axial direction, as shown in FIGS. 6(B) and 6(C), thus causing displacement E1 of the cooling stage 14.

On the other hand, as shown in FIG. 7(A), oscillating gas pressure P2 in the second refrigerant tube 18 is also controlled to be changed periodically due to supply of high-pressure gas to the second refrigerant tube 18 and recovery of low-pressure gas from the second refrigerant tube 18. This change of the oscillating gas pressure P2 causes extension and contraction of the second pulse tube 18A and the second regenerator 18B of the second refrigerant tube 18 in the axial direction, thus causing the axial displacement of the cooling stage 14. For example, at time T in FIG. 7(A), the oscillating gas pressure PL causes contraction of the second pulse tube 18A and the second regenerator 18B in the axial direction, thus causing displacement E2 of the cooling stage 14.

As described above, in the cooling stage 14 of the cryogenic refrigerator 10, the displacement caused by extension and contraction of the first refrigerant tube 16 and that caused by extension and contraction of the second refrigerant tube 18 occur, respectively.

However, the cryogenic refrigerator 10 is arranged in such a manner that the oscillating gas pressure P1 in the first refrigerant tube 16 and the oscillating gas pressure P2 in the second refrigerant tube 18 have a phase difference of 180 degrees therebetween, as shown in FIG. 8(A). Therefore, as shown in FIG. 8(B), while the first refrigerant tube 16 extends in the axial direction, the second refrigerant tube 18 contracts in the axial direction. On the other hand, while the first refrigerant tube 16 contracts in the axial direction, the second refrigerant tube 18 extends in the axial direction. Thus, the displacement caused by the extension and contraction of the first refrigerant tube 16 can be canceled by the displacement caused by the extension and contraction of the second refrigerant tube 18. As a result, the displacement of the cooling stage 14 can be made substantially zero.

According to the cryogenic refrigerator 10 of this embodiment of the present invention, a plurality of refrigerant tubes are provided in such a manner that oscillating gas pressures therein have phase differences. Thus, the vibration of the cooling stage 14 can be canceled out, resulting in effective reduction of the vibration and the size reduction.

In addition, four tubes, i.e., the first pulse tube 16A and the first regenerator 16B of the first refrigerant tube 16 and the second pulse tube 18A and the second regenerator 18B of the second refrigerator 18 are arranged at substantially constant intervals along the circumferential direction of the cooling stage 14 in such a manner that the first pulse tube 16A and the first regenerator 16B are located at the farthest positions from each other (the same is true for the second pulse tube 18A and the second regenerator 18B). Therefore, the effect of reducing the vibration can be further enhanced.

The degree of the effect of reducing the vibration is varied depending on material for the cooling stage 14, the size thereof, or the like. However, experiments by the inventor of the present application shows, even allowing the cooling stage 14 to be formed of elastic material, the vibration can be reduced to a tenth to a hundredth of the conventional vibration while the size is kept within a practical range.

The size and the structure of the cryogenic refrigerator of the present invention is not limited to those of the cryogenic refrigerator 10 in the above embodiment. The cryogenic refrigerator of the present invention can have various structure, as long as it includes a plurality of refrigerant tubes which have oscillating gas pressures with phases differences therebetween in such a manner that those phase differences act to cancel the vibration of the cooling stage.

Figure 9:
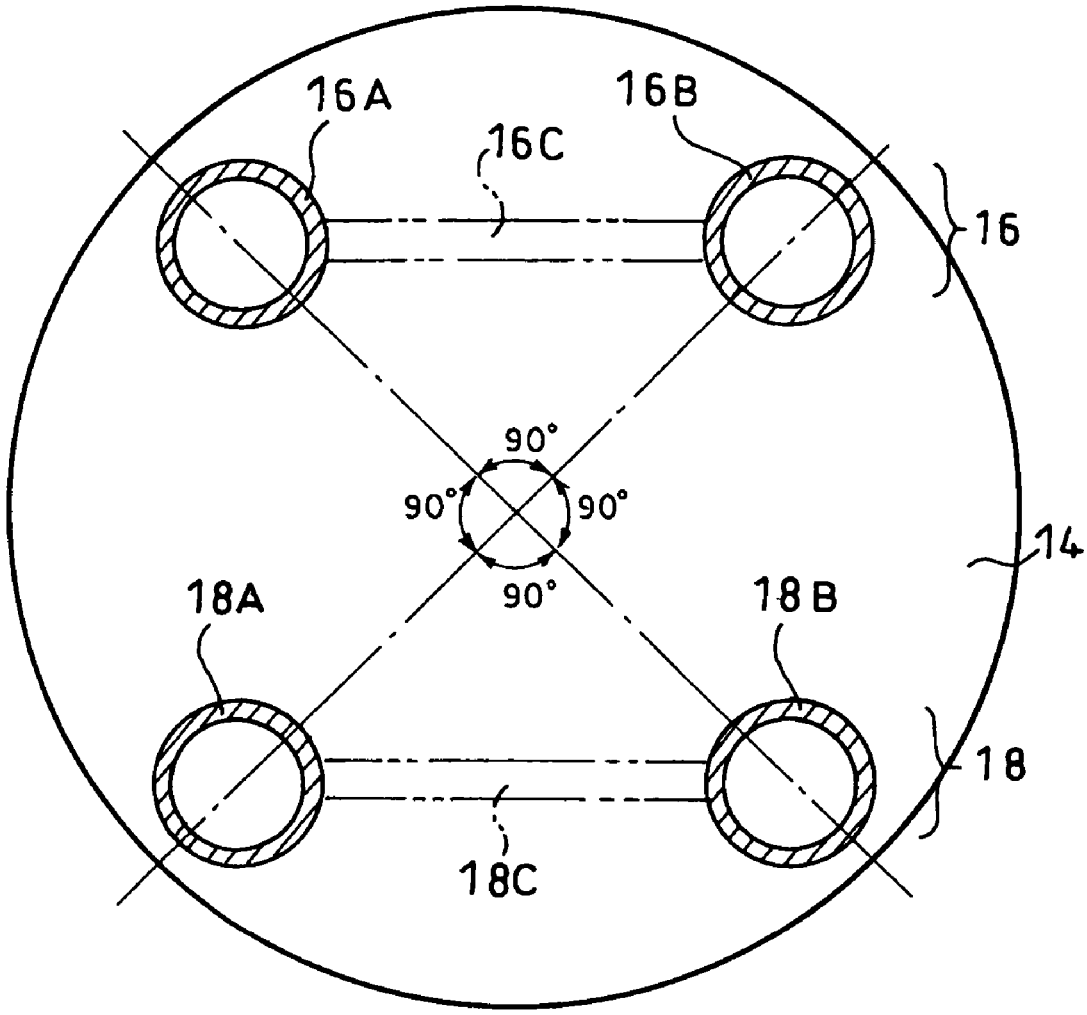
FIG. 9 is a cross sectional view showing another arrangement of the refrigerant tubes in the cryogenic refrigerator in FIG. 3.

Therefore, as shown in FIG. 9, the first pulse tube 16A and the first regenerator 16B of the first refrigerant tube 16 and the second pulse tube 18A and the second regenerator 18B of the second refrigerant tube 18 may be arranged along the circumferential direction of the cooling stage 14 at substantially constant intervals in such a manner that the first pulse tube 16A and the first regenerator 16B are located at the closest positions from each other (the same is true for the second pulse tube 18A and the second regenerator 18B). In this case, the gas passage 16C through which the first pulse tube 16A and the first regenerator 16B communicate with each other and the gas passage 18C through which the second pulse tube 18A and the second regenerator 18B communicate with each other can be shortened, thus ensuring the best cooling effect. Please note that in this case it is preferable to mount an object to be cooled around the center of the cooling stage 14 because the center can provide the most effective reduction of vibration.

Figure 10:
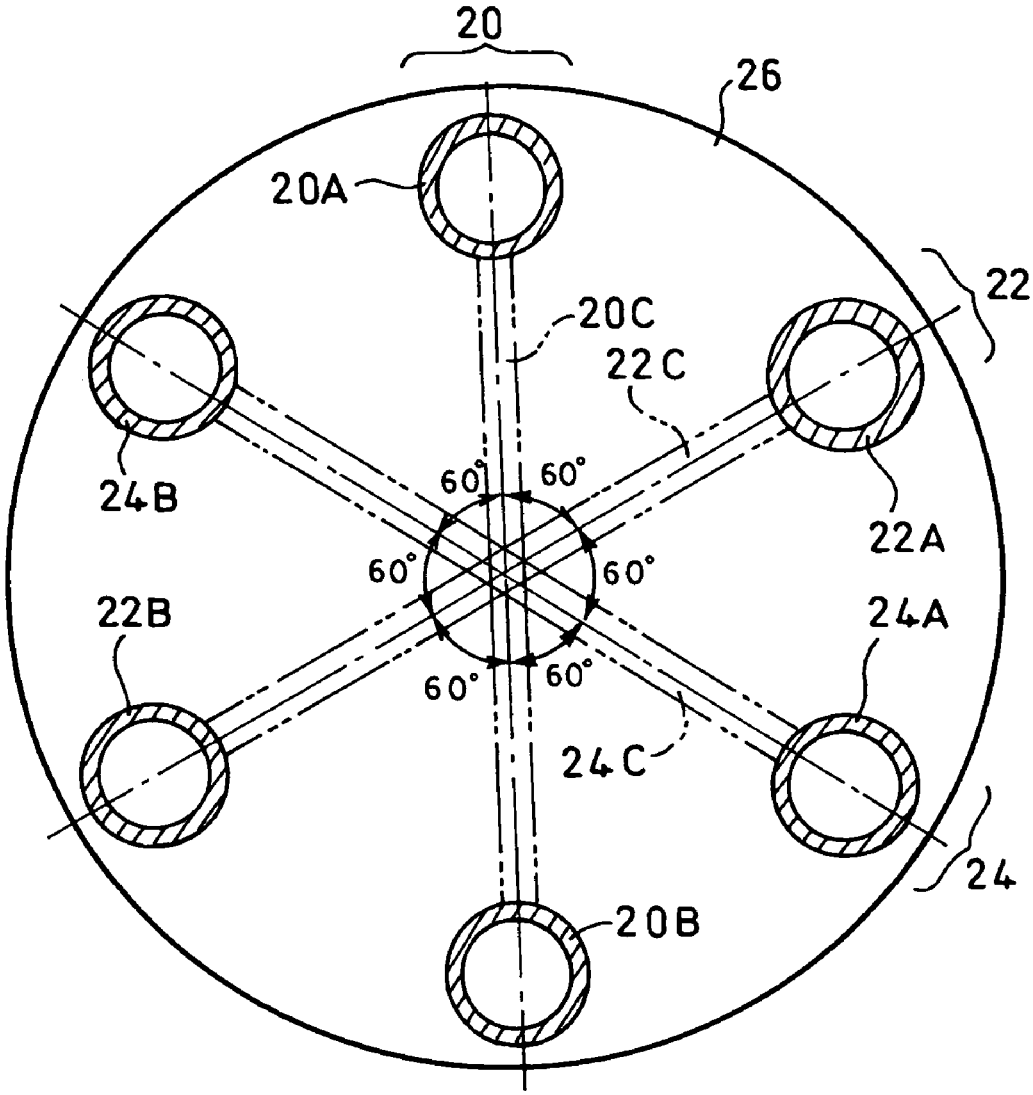
FIG. 10 is a cross sectional view schematically showing a cryogenic refrigerator according to another embodiment of the present invention.
Figure 11:
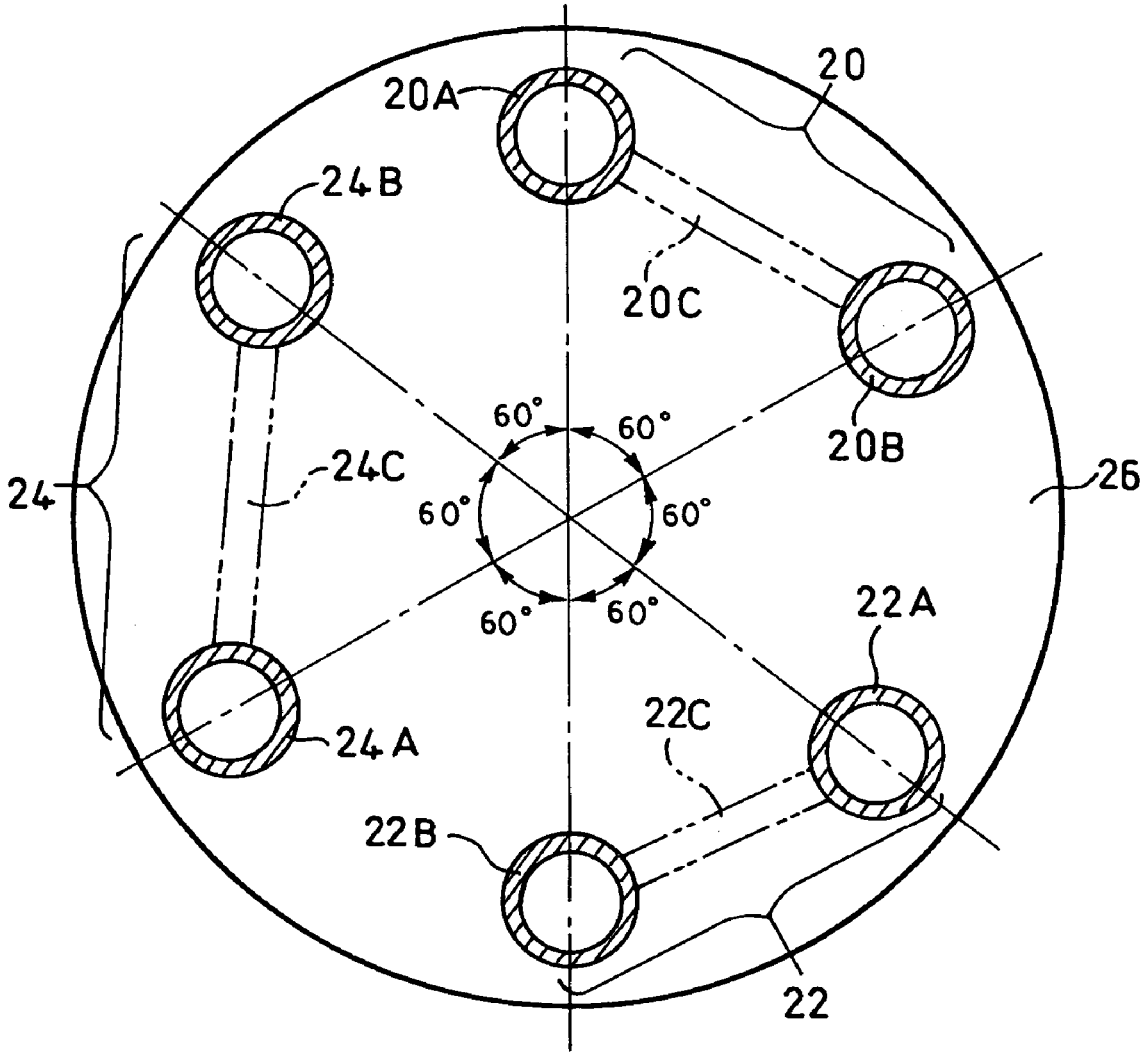
FIG. 11 is a cross sectional view showing another arrangement of the refrigerant tubes in the cryogenic refrigerator in FIG. 10.
Figure 12:
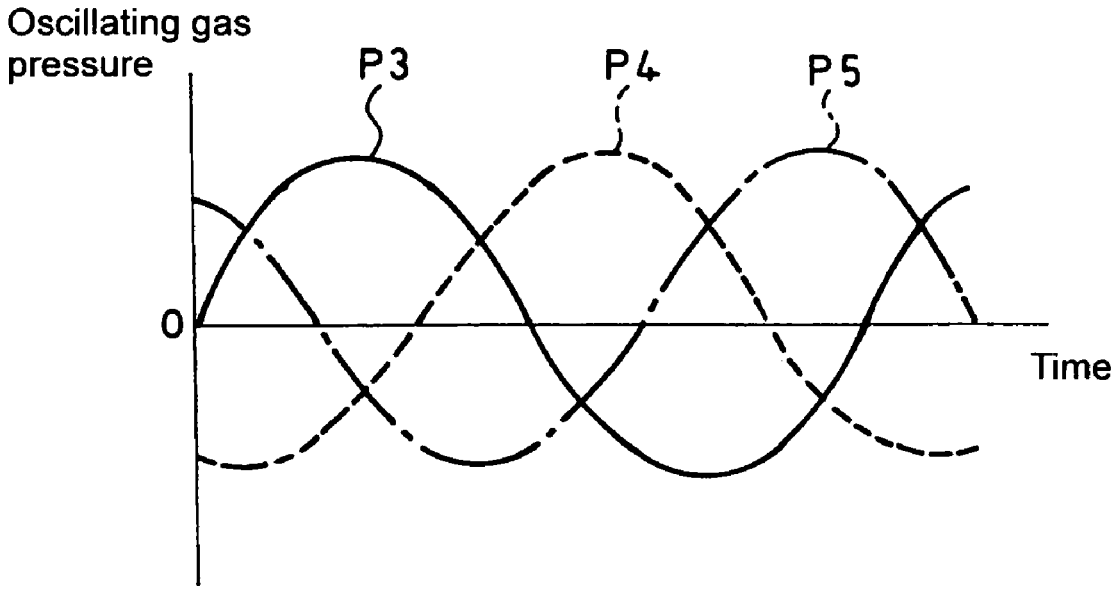
FIG. 12 is a graph showing a relationship between oscillating gas pressures in the cryogenic refrigerator shown in FIGS. 10 and 11 and time.
Figure 13:
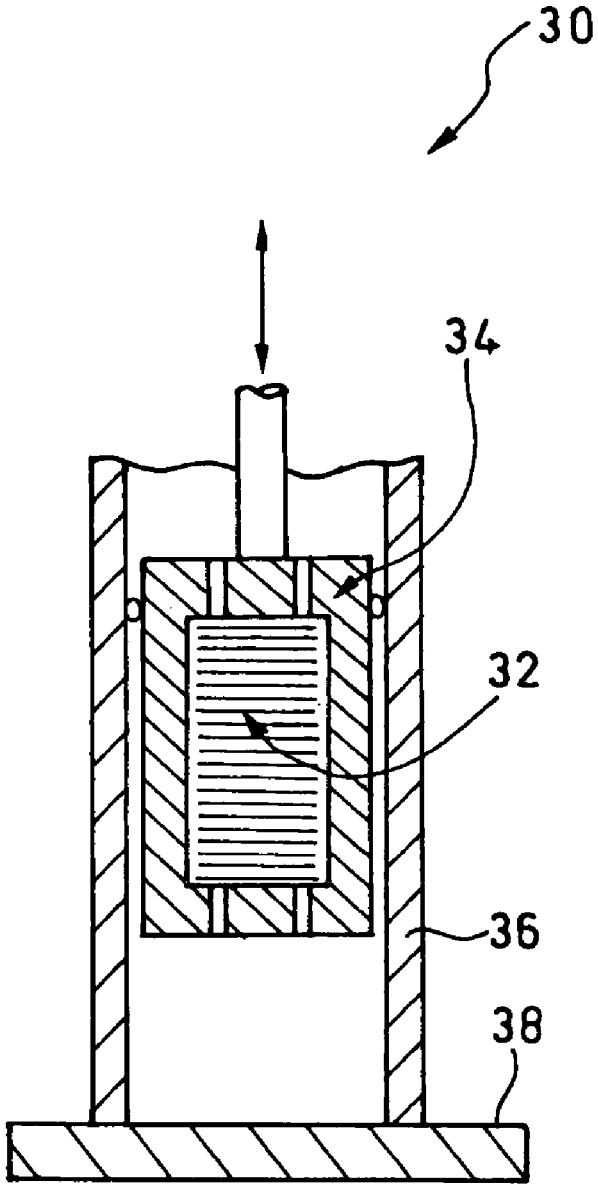
FIG. 13 is a schematic cross sectional view showing a cryogenic refrigerator including a single cylinder.

Moreover, the cryogenic refrigerator of the present invention may include three or more refrigerant tubes. For example, as shown in FIGS. 10 and 11, three refrigerant tubes, i.e., first, second, and third refrigerant tubes 20, 22, 24 may be provided. In this case, by making oscillating gas pressures P3, P4, and P5 in those three refrigerant tubes 20, 22, and 24 have phase differences of 120 degrees, as shown in FIG. 12, the vibration of the cooling stage 26 can be canceled. In this manner, provision of a plurality of refrigerant tubes can further reduce the vibration because there remain higher-order oscillation modes only. In addition, in order to effectively reduce the vibration of the cooling stage, it is preferable that the phase differences between the oscillating gas pressures be set to 360/N degrees in a case where N refrigerant tubes are provided, where N is an integer larger than one.

In the above embodiments, each of the first and second refrigerant tubes 16 and 18 is formed by the pulse tube and the regenerator. However, the present invention is not limited thereto. Each refrigerant tube may be formed by the regenerator and a cylinder accommodating the displacer therein, for example.

Moreover, the present invention can be applied to a cryogenic refrigerator including a cylinder (refrigerant tube) 36 in which a displacer 34 incorporating a regenerator 32 therein is arranged to reciprocate within the cylinder 36. In this case, the same effects as those mentioned above can be achieved by providing N cylinders 36 along the circumferential direction of a cooling stage 38 substantially constant intervals and giving oscillating gas pressures in those N cylinders 36 phase differences of 360/N degrees, where N is an integer larger than one. It should be noted that the present invention can also be applied to a multistage cryogenic refrigerator including two or more stages of regenerators.

The disclosure of Japanese Patent Application No. 2003-165908 filed on Jun. 11, 2003 including specification, drawings, and claims is incorporated herein by reference in its entirety.

Although only a limited number of the embodiments of the present invention have been described, it should be understood that the present invention is not limited thereto, and various modifications and variations can be made without departing from the spirit and scope of the invention defined in the accompanying claims.

What is claimed is:

1. A cryogenic refrigerator, comprising:

a high temperature end block;

a plurality of refrigerant tubes, each comprising a pair of tubes that are arranged substantially parallel to each other, each tube extending in an axial direction;

a cooling stage in a form of a single body member disposed apart from the high temperature end block in a generally parallel manner with each one of the pair of tubes mounted to and between the cooling stage and the high temperature end block and respective ones of each pair of tubes being in direct fluid communication with each other through a respective gas passage formed in and through the cooling stage, the respective gas passages being in fluid isolation from one another in the cooling stage; and means for oscillating and controlling gas pressures in each respective pair of tubes, wherein the gas pressures are sufficient to cause selected ones of the pairs of refrigerant tubes to contract in the axial direction or expand in the axial direction while an equal number of remaining ones of the pairs of refrigerant tubes expand in the axial direction when the selected ones of the refrigerant tubes contract in the axial direction or contract in the axial direction when the selected ones of the refrigerant tubes expand in the axial direction, and wherein controlled oscillating gas pressures in the plurality of refrigerant tubes have phase differences, to thereby cancel vibration of the cooling stage.

2. The cryogenic refrigerator according to claim 1, wherein the tubes of the plurality of respective refrigerant tubes are arranged at substantially constant intervals along a circumferential direction of the cooling stage in such a manner that the two tubes of each refrigerant tube are located at the farthest positions from each other.

3. The cryogenic refrigerator according to claim 1, wherein the tubes of the plurality of respective refrigerant tubes are arranged at substantially constant intervals along a circumferential direction of the cooling stage in such a manner that the two tubes of each refrigerant tube are located at the closest positions to each other.

4. The cryogenic refrigerator according to claim 1, wherein when N refrigerant tubes are provided and N is an integer larger than one, the phase difference is set to 360/N degrees.

5. The cryogenic refrigerator according to claim 1, wherein the two tubes comprises a regenerator and a pulse tube.

6. The cryogenic refrigerator according to claim 1, wherein the two tubes comprises a regenerator and a cylinder accommodating a displacer therein.

7. A cryogenic refrigerator, comprising:

a plurality of single cylinders, each single cylinder extending in an axial direction;

a cooling stage in a form of a single body member with the plurality of single cylinders extending parallel with one another and perpendicularly to the cooling stage, the plurality of single cylinders connected to the cooling stage and with each single cylinder including a displacer disposed in the single cylinder and operative to reciprocate within the single cylinder and a regenerator disposed within the displacer; and means for oscillating and controlling gas pressures in each one of the plurality of single cylinders; wherein N single cylinders are arranged along a circumferential direction of the cooling stage at substantially constant intervals where N is an integer larger than one, and oscillating and controlled gas pressures in the N single cylinders have phase differences of 360/N degrees to cancel vibration of the cooling stage, wherein the gas pressures are sufficient to cause selected ones of the single cylinders to contract in the axial direction or expand in the axial direction while an equal number of remaining ones of the single cylinders expand when the selected ones of the single cylinders contract or contract when the selected ones of the single cylinders expand.

8. A cryogenic refrigerator, comprising:

a first refrigerant tube extending in an axial direction and including a first pulse tube and a first regenerator tube disposed apart from and parallel to the first pulse tube;

a second refrigerant tube extending in the axial direction and including a second pulse tube and a second regenerator tube disposed apart from and parallel to the second pulse tube;

a cooling stage in a form of a single body member with the first and second refrigerant tubes operably connected perpendicularly thereto, the cooling stage having a first gas passage formed therein so that the first pulse tube and the first regenerator tube are in fluid communication with each other and a second gas passage formed therein and in fluid isolation from the first gas passage so that the second pulse tube and the second regenerator tube are in fluid communication with each other; and means for oscillating and controlling gas pressures in the first and second refrigerant tubes, wherein the gas pressures are sufficient to cause the first pulse tube and the first regenerator tube to contract in the axial direction or expand in the axial direction while the second pulse tube and the second regenerator tube expand in the axial direction when the first pulse tube and the first regenerator tube contract in the axial direction or contract in the axial direction when the first pulse tube and the first regenerator tube expand in the axial direction, and wherein controlled oscillating gas pressures in the first and second refrigerant tubes have phase differences sufficient to cancel vibration of the cooling stage.

* * * * *